US009390654B2

(12) United States Patent
Xu

(10) Patent No.: US 9,390,654 B2
(45) Date of Patent: Jul. 12, 2016

(54) PIXEL DRIVING CIRCUIT AND ARRAY SUBSTRATE OF OLED DISPLAY AND THE CORRESPONDING DISPLAY

(71) Applicant: Shenzhen China Star Optoelectronics Technology Co., Ltd., Shenzhen, Guangdong (CN)

(72) Inventor: Xiangyang Xu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 67 days.

(21) Appl. No.: 14/374,240

(22) PCT Filed: Apr. 17, 2014

(86) PCT No.: PCT/CN2014/075572

§ 371 (c)(1),
(2) Date: Jul. 24, 2014

(87) PCT Pub. No.: WO2015/149397

PCT Pub. Date: Oct. 8, 2015

(65) Prior Publication Data

US 2015/0279276 A1 Oct. 1, 2015

(30) Foreign Application Priority Data

Apr. 1, 2014 (CN) ..... 2014 1 0127996

(51) Int. Cl.
*G09G 3/30* (2006.01)
*G09G 3/32* (2016.01)

(52) U.S. Cl.
CPC ..... *G09G 3/3258* (2013.01); *G09G 2300/0842* (2013.01); *G09G 2310/027* (2013.01); *G09G 2310/0248* (2013.01); *G09G 2320/0233* (2013.01); *G09G 2320/0626* (2013.01)

(58) Field of Classification Search
CPC ..... F02F 1/133514; G09G 3/3233; G09G 3/3258; G09G 2310/0248; G09G 2310/027
USPC ..... 345/208, 76; 314/169.3
See application file for complete search history.

(56) References Cited

U.S. PATENT DOCUMENTS 4,651,148 A * 3/1987 Takeda ..... G02F 1/133514 345/208
2007/0296651 A1* 12/2007 Kim ..... G09G 3/3233 345/76
2015/0179101 A1* 6/2015 Ohara ..... G09G 3/3233 345/76

* cited by examiner

*Primary Examiner* — Andrew Sasinowski
*Assistant Examiner* — Kuo Woo
(74) *Attorney, Agent, or Firm* — Andrew C. Cheng

(57) ABSTRACT

The present invention discloses a pixel driving circuit of OLED display, which comprises: a scanning transistor TFT1, the source thereof being connected to the data line, the gate thereof being connected to a current row scanning control line, the drain thereof being connected to a first terminal of a storage capacitor C1; a precharging transistor TFT3, the source thereof being connected to the data line, the gate thereof being connected to a previous row scanning control line, and the drain thereof being connected to the first terminal of the storage capacitor C1; a driving transistor TFT2; and an organic light emitting diode; wherein, the scanning time of the current row scanning control line at least partially overlaps that of the previous row scanning control line. The embodiment of the present invention can improve the charging efficiency of the storage capacitor in each pixel unit and then improve the display effects.

6 Claims, 3 Drawing Sheets

PIXEL DRIVING CIRCUIT AND ARRAY SUBSTRATE OF OLED DISPLAY AND THE CORRESPONDING DISPLAY

This application is claiming a priority arisen from a patent application, entitled with "Pixel Driving Circuit and Array Substrate of OLED Display and the Corresponding Display", submitted to China Patent Office on Apr. 1, 2014, designated with an Application Number 201410127996.2. The whole and complete disclosure of such patent application is hereby incorporated by reference. This application also related to National Stage application Ser. No. 14/374,248, submitted on the same date, entitled, "Array Substrate of OLED Display"; and National Stage Application Ser. No. 14/374,269, submitted on the same date, entitled, "Pixel Driving Circuit of OLED Display and the Driving Method Thereof" assigned to the same assignee.

BACKGROUND OF THE INVENTION

1. Field of the Invention

The present invention relates to the fields of pixel driving technology of the light emitting diode display, and in particular to a pixel driving circuit and an array substrate of organic light emitting diode (OLED) display and the corresponding display.

2. The Related Arts

Organic Light Emitting Diode (OLED) has features of faster response, higher contrast, wider viewing angle and etc. compared to conventional liquid crystal panel. Hence, OLED has the increasingly widespread attention from the display technology developers.

FIG. 1 shows the schematic diagram of a pixel driving circuit of OLED display according to the existing technology. It is a pixel driving circuit of voltage driving type composed by 2 TFT transistors and a capacitor (2T1C).

Wherein, under the control of the signal of the scanning control line (Gate_n), a first transistor TFT1 will transfer the voltage from the data lines (Data_n) to the gate of the driving transistor TTFT2, the driving transistor TFT2 will transform the data voltage into the corresponding current for the OLED. During normal operation, the driving transistor TFT2 should be in the saturation region to provide a stable driving current for OLED within the scanning time of one row.

Referring to FIG. 2, it shows a gate scanning timing diagram of the circuit used in FIG. 1. Wherein, CLKA/B is a clock signal of the gate scanning IC, and STV is a gate scanning synchronizing signal. Wherein, the gate scanning is achieved by turning on row by row. After the previous row scanning is turned off, the next row scanning is turned on. The scanning time is 1/(F×n). Wherein, F represents the field scanning frequency of the OLED display, and n represents the row scanning frequency of the OLED display.

However, in the existing pixel driving circuit, when inputting the same gray scale voltage, there are different threshold voltages within different driving transistors TFT2 corresponding to different pixel units, so different driving transistors TFT2 will generate different currents, leading to inconsistency of driving current in a OLED display panel. Moreover, for high-resolution AMOLED display, it is limited by the size of the TFT1, and each row of pixel units begin to work just after the previous row scanning time is finished, so the saturation current of the TFT1 can not be satisfied. That is, in the scanning time of one row, there may be a risk that the storage capacitor C1 can not be charged to the predetermined voltage, which will affect the driving current input to the OLED.

SUMMARY OF THE INVENTION

The technical issue to be solved by the present invention is to provide a pixel driving circuit and an array substrate of OLED display and the corresponding display, which can improve the charging efficiency of the storage capacitor in each pixel unit and then improve the display effects.

In order to solve the technical issue, the present invention provides a pixel driving circuit of OLED display, comprising:

a scanning transistor TFT1, the source thereof being connected to the data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the scanning time of the current row scanning control line at least partially overlaps that of the previous row scanning control line.

Wherein, the scanning time of each current row scanning control line and that of the previous row scanning control line have an overlap of ½ pulse width.

Wherein, the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

Correspondingly, the embodiment of the present invention further provides an array substrate of OLED display, comprising multiple pixel units defined by multiple rows of scanning control lines and multiple columns of data lines; wherein, each pixel unit comprises a pixel driving circuit, the pixel driving circuit comprises:

a scanning transistor TFT1, the source thereof being connected to a current column data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the current column data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the scanning time of the current row scanning control line at least partially overlaps that of the previous row scanning control line.

Wherein, the scanning time of each current row scanning control Line and that of the Previous Row Scanning Control Line have an Overlap of ½ pulse width.

Wherein, the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

Correspondingly, the embodiment of the present invention further provides an OLED display, which comprises an array substrate of OLED display; wherein, the array substrate of OLED display comprises multiple pixel units defined by multiple rows of scanning control lines and multiple columns of data lines, each pixel unit comprises a pixel driving circuit, and the pixel driving circuit comprises:

a scanning transistor TFT1, the source thereof being connected to a current column data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the current column data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the scanning time of the current row scanning control line at least partially overlaps that of the previous row scanning control line.

Wherein, the scanning time of each current row scanning control line and that of the previous row scanning control line have an overlap of ½ pulse width.

Wherein, the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

The embodiment of the present invention has the following benefits:

Because a precharging transistor TFT3 is used in the pixel driving circuit of each pixel unit, and the scanning time of the current row scanning control line connected with the gate of the precharging transistor TFT3 partially overlaps that of the previous row scanning control line (ex. overlap of ½ pulse width), it can be achieved through the precharging transistor TFT3 that the storage capacitor C1 can be charged in advance during the previous row scanning cycle, which can improve the charging efficiency. Therefore, it can make sure to achieve the predetermined voltage, so that the driving transistor TFT2 can provide a stable driving current for OLED and then improve the display effects of the OLED display.

BRIEF DESCRIPTION OF THE DRAWINGS

In order to more clearly illustrate the embodiment of the present invention or the technical issue of the prior art, the accompanying drawings and the detailed descriptions are as follows. Obviously, the following description of the accompanying drawings are only some embodiments according to the present invention, for persons of ordinary skill in this field, they can also obtain other drawings based on these drawings without creative effort.

DETAILED DESCRIPTION OF THE PREFERRED EMBODIMENTS

The detailed descriptions accompanying drawings and the embodiment of the present invention are as follows.

Figure 1:
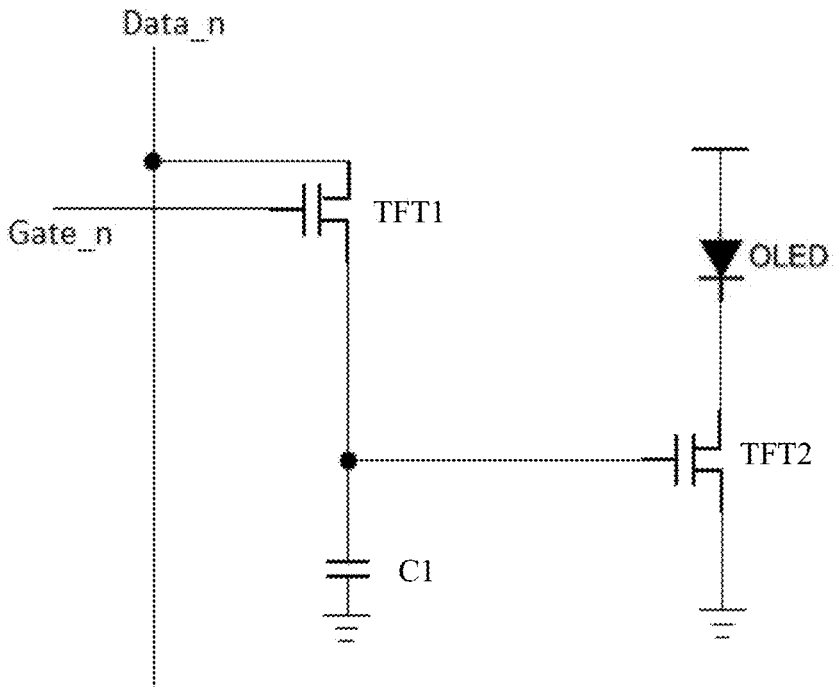
FIG. 1 is a pixel driving circuit of OLED display according to the existing technology.
Figure 2:
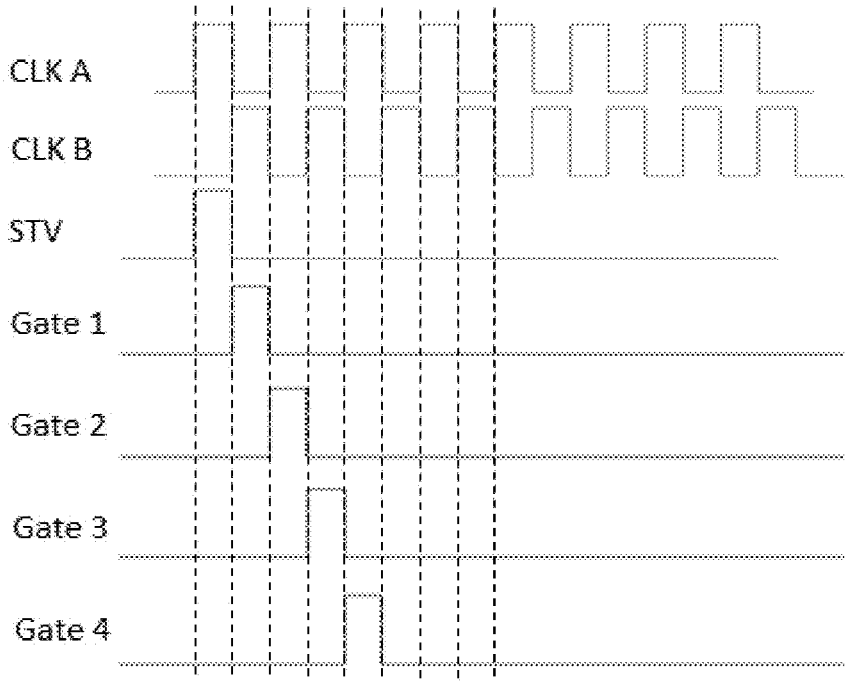
FIG. 2 is a gate scanning timing diagram of the circuit used in FIG. 1.
Figure 3:
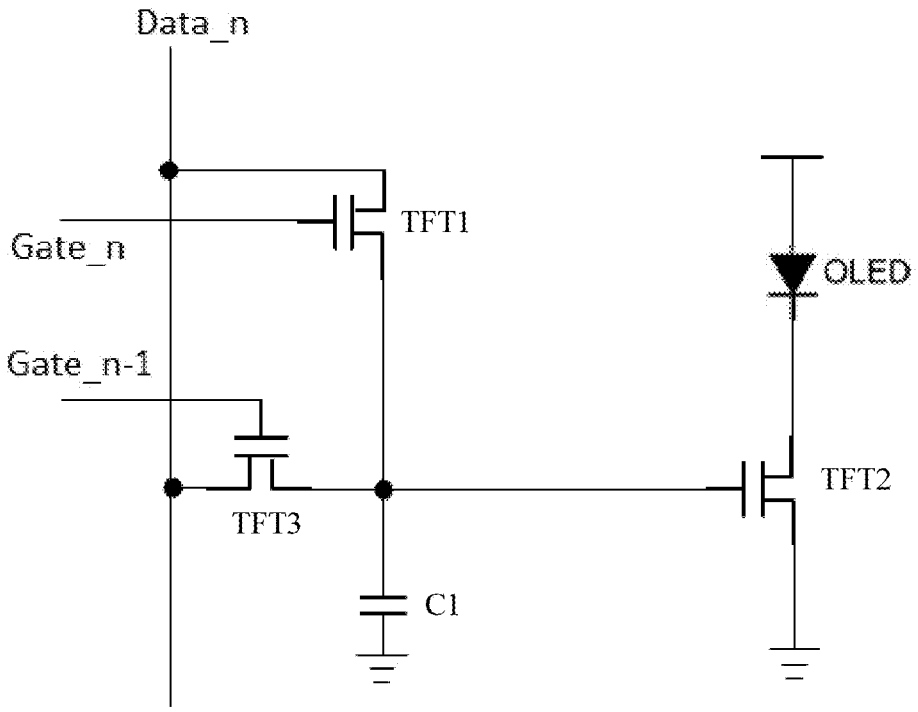
FIG. 3 is a circuit diagram of the pixel driving circuit of OLED display according to an embodiment of the present invention.

Referring to FIG. 3, it shows a circuit diagram of the pixel driving circuit of OLED display according to an embodiment of the present invention. In the embodiment, each pixel unit is provided with a pixel driving circuit. Wherein, the pixel driving circuit comprises:

a scanning transistor TFT1, the source thereof being connected to the data line (such as Data_n), the gate thereof being connected to a current row scanning control line (such as Gate_n), the drain thereof being connected to a first terminal of a storage capacitor C1, and a second terminal of the storage capacitor C1 being grounded;

a precharging transistor TFT3, the source thereof being connected to the data line, the gate thereof being connected to a previous row scanning control line (such as Gate_n−1), and the drain thereof being connected to the first terminal of the storage capacitor C1;

a driving transistor TFT2, the gate thereof being connected to the drain of the scanning transistor TFT1, and the drain thereof being grounded; and an organic light emitting diode (OLED), the negative electrode thereof being connected to the source of the driving transistor TFT2, and the positive electrode thereof being connected to a power line Vdd;

wherein, the scanning time of the current row scanning control line (such as Gate_n) at least partially overlaps that of the previous row scanning control line (such as Gate_n−1). For example, it can have an overlap of ½ pulse width. It can be understood that the overlap time can be chosen according to the actual needs.

Figure 4:
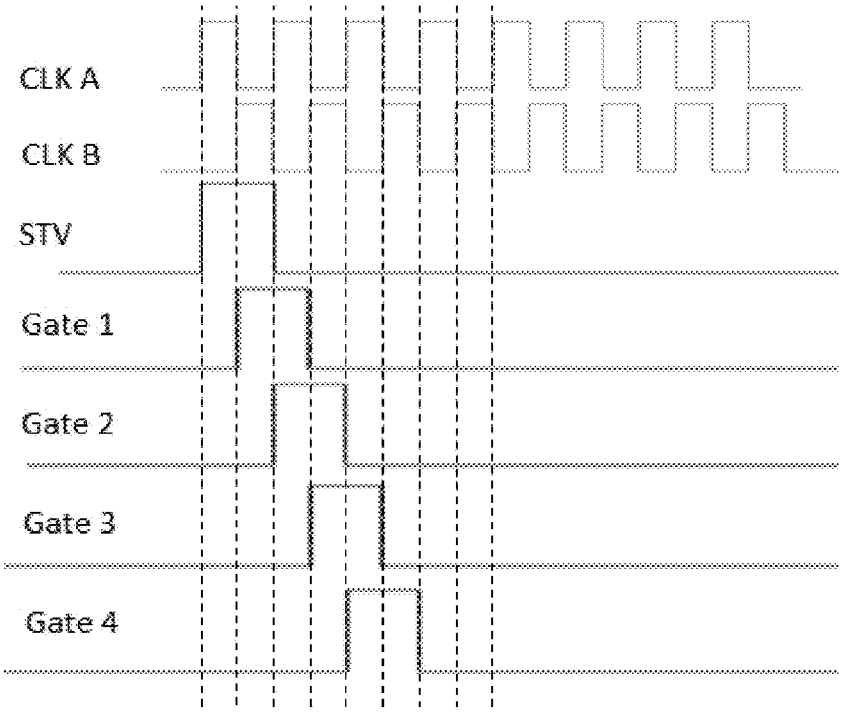
FIG. 4 is a gate scanning timing diagram of the circuit used in FIG. 3.

Specifically, referring to FIG. 4, it shows a gate scanning timing diagram of the circuit used in FIG. 3. In the embodiment, CLKA/B is a clock signal of the gate scanning IC, and STV is a gate scanning synchronizing signal. Wherein, the gate scanning is achieved by turning on row by row. After the previous row scanning is turned off, the next row scanning is turned on. The scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n). For example, the first half of the scanning time of the scanning control line Gate 2 overlaps the second half of the scanning time of the scanning control line Gate 1, and so on. Wherein, F represents the field scanning frequency of the OLED display, and n represents the row scanning frequency of the OLED display.

It can be seen that there is 1/(F×n) time of the sharing charging time between the two adjacent gate scans. Therefore, it can make sure that each storage capacitor C1 in the OLED driving circuit of the current row pixel unit has enough charging time to achieve the predetermined gray scale voltage.

The real charging time of each row actually has the second half pulse time, so there will be no crosstalk. Because OLED is driven by current, the requirement of the voltage remains of the driving transistor TFT2 is very strict. The main function of the storage capacitor C1 is to keep the voltage of the OLED driving transistor. If it is too low, the charge retention will decrease. Therefore, the size of the storage capacitor C1 can not be decreased. However, the circuit according to the embodiment of the present invention utilizes precharge mechanism. There is an overlap time of 1/(F×n) of the sharing charging time between the two adjacent gate scans, that is, when the previous row scanning control line is under the second half scanning time, the storage capacitor C1 begins to be charged to the gray scale voltage of the previous row during the first half scanning time of the current row scanning control line. Therefore, the storage capacitor C1 can be easily charged to the predetermined gray scale voltage during the second half scanning time of the current row scanning control line, so that it can improve the charging efficiency and the charging effects of the storage capacitor C1.

Figure 5:
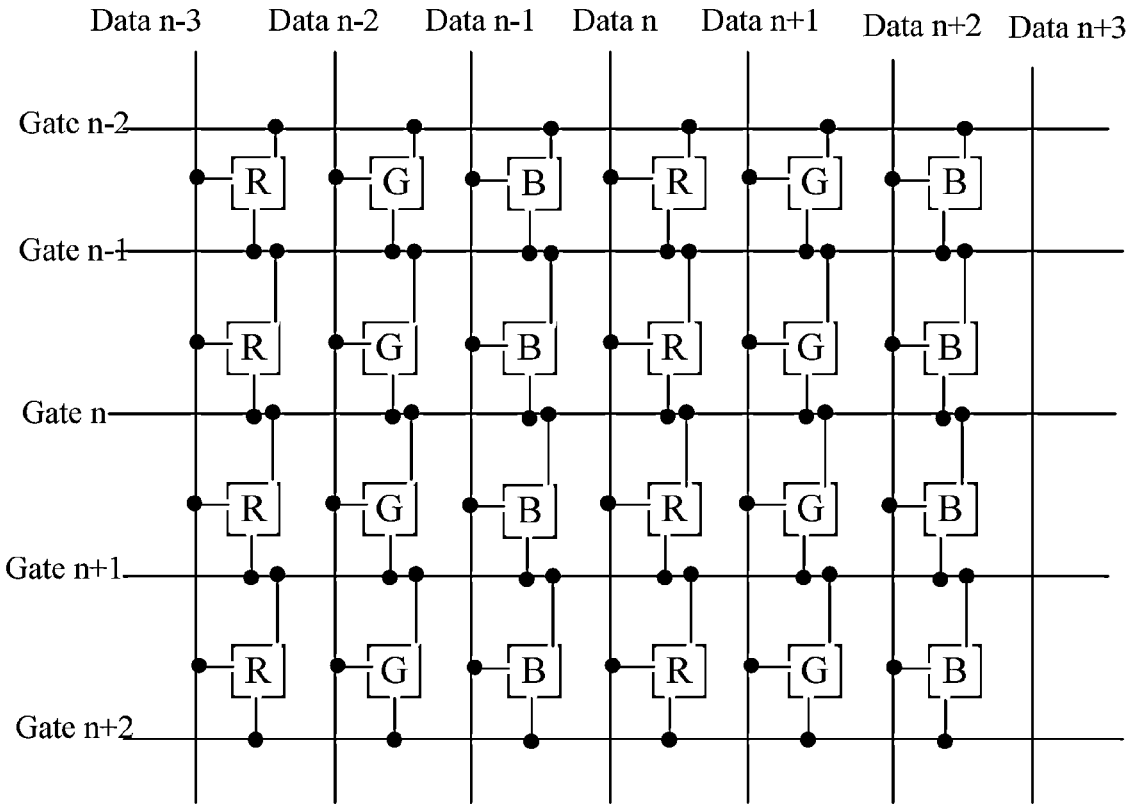
FIG. 5 is a schematic view illustrating the structure of the array substrate of OLED display according to an embodiment of the present invention.

Referring to FIG. 5, it shows a schematic view illustrating the structure of the array substrate of OLED display according to an embodiment of the present invention. In the present embodiment, the array substrate of OLED display comprises multiple pixel units defined by multiple rows of scanning control lines (only Gate n−2~Gate n+2 shown in Figure) and multiple columns of data lines (only Data n−3~Data n+3 shown in Figure). Each pixel unit comprises a pixel driving circuit. The pixel unit utilizes the pixel driving circuit shown in FIG. 3. Specifically, the pixel driving circuit comprises: a scanning transistor TFT1, the source thereof being connected to a current column data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the current column data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the scanning time of the current row scanning control line at least partially overlaps that of the previous row scanning control line. For example, it can have an overlap of ½ pulse width.

Wherein, the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

More details can refer to the descriptions of FIG. 3 and FIG. 4, which is not repeated here.

Correspondingly, the embodiment of the present invention further provides an OLED display using the array substrate shown in FIG. 5, and the specific details can refer to the above description.

The embodiment of the present invention has the following benefits:

Because a precharging transistor TFT3 is used in the pixel driving circuit of each pixel unit, and the scanning time of the current row scanning control line connected with the gate of the precharging transistor TFT3 partially and that of the previous row scanning control line have an overlap of ½ pulse width, it can be achieved through the precharging transistor TFT3 that the storage capacitor C1 can be charged in advance during the previous row scanning cycle, which can improve the charging efficiency. Therefore, it can make sure to achieve the predetermined voltage, so that the driving transistor TFT2 can provide a stable driving current for OLED and then improve the display effects of the OLED display.

The preferred embodiments of the present invention have been described, but not intending to impose any unduly constraint to the appended claims. Any deduction or modification according to the present invention is considered encompassed in the scope of protection defined by the claims of the present invention.

What is claimed is:

1. A pixel driving circuit of OLED display, comprising:

a scanning transistor TFT1, the source thereof being connected to the data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the pixel driving circuit is disposed in a pixel unit, and the scanning time of each current row scanning control line and that of the previous row scanning control line have an overlap of ½ pulse width.

2. The pixel driving circuit of OLED display as claimed in claim 1, wherein the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

3. An array substrate of OLED display, comprising multiple pixel units defined by multiple rows of scanning control lines and multiple columns of data lines; wherein, each pixel unit comprises a pixel driving circuit, the pixel driving circuit comprises:

a scanning transistor TFT1, the source thereof being connected to a current column data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the current column data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the scanning time of each current row scanning control line and that of the previous row scanning control line have an overlap of ½ pulse width.

4. The array substrate of OLED display as claimed in claim 3, wherein the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

5. An OLED display, which comprises an array substrate of OLED display; wherein, the array substrate of OLED display comprises multiple pixel units defined by multiple rows of scanning control lines and multiple columns of data lines, each pixel unit comprises a pixel driving circuit, and the pixel driving circuit comprises:

a scanning transistor TFT1, the source thereof being connected to a current column data line, the gate thereof being connected to a current row scanning control line, the drain thereof being connected to a first terminal of a storage capacitor C1, and a second terminal of the storage capacitor C1 being grounded;

a precharging transistor TFT3, the source thereof being connected to the current column data line, the gate thereof being connected to a previous row scanning control line, and the drain thereof being connected to the first terminal of the storage capacitor C1;

a driving transistor TFT2, the gate thereof being connected to the drain of the scanning transistor TFT1, and the drain thereof being grounded; and an organic light emitting diode, the negative electrode thereof being connected to the source of the driving transistor TFT2, and the positive electrode thereof being connected to a power line Vdd;

wherein, the scanning time of each current row scanning control line and that of the previous row scanning control line have an overlap of ½ pulse width.

6. The OLED display as claimed in claim 5, wherein the scanning time of the current row scanning control line and that of the previous row scanning control line both are 2/(F×n), the first half of the scanning time of the current row scanning control line overlaps the second half of the scanning time of the previous row scanning control line, and both have an overlap time of 1/(F×n); wherein, F represents the field scanning frequency of the OLED display, and n represents the row scanning frequency of the OLED display.

* * * * *